US008952282B2

(12) United States Patent
Nakase et al.

(10) Patent No.: US 8,952,282 B2
(45) Date of Patent: Feb. 10, 2015

(54) PUSH-ON SWITCH HAVING IMPROVED ACTUATOR

(75) Inventors: Yusho Nakase, Yokohama (JP); Jian-Bo Zhou, Shenzhen (CN); Liang Sun, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 417 days.

(21) Appl. No.: 13/281,744

(22) Filed: Oct. 26, 2011

(65) Prior Publication Data

US 2012/0097515 A1 Apr. 26, 2012

(30) Foreign Application Priority Data

Oct. 26, 2010 (CN) ..... 2010 2 0576942

(51) Int. Cl.
*H01H 1/10* (2006.01)
*H01H 13/85* (2006.01)

(52) U.S. Cl.
CPC ..... *H01H 13/85* (2013.01); *H01H 2221/052* (2013.01); *H01H 2221/082* (2013.01)
USPC ..... 200/517; 200/345

(58) Field of Classification Search
USPC ..... 200/345, 517, 406
See application file for complete search history.

(56) References Cited

U.S. PATENT DOCUMENTS

| | | | | |
|---|---|---|---|---|
| 6,501,036 | B2 | 12/2002 | Rochon et al. | |
| 6,894,240 | B2 * | 5/2005 | Komoto et al. | 200/512 |
| 7,109,431 | B2 | 9/2006 | Yanai et al. | |
| 2005/0224330 | A1 * | 10/2005 | Liu et al. | 200/345 |

* cited by examiner

*Primary Examiner* — Renee S Luebke
*Assistant Examiner* — Lheiren Mae A Caroc
(74) *Attorney, Agent, or Firm* — Ming Chieh Chang; Wei Te Chung

(57) ABSTRACT

A push-on switch includes an insulating housing (1) defining a recess (10) at its top, a first fixed contact (21) and a second fixed contact (22) received at the bottom of the recess (10), a dome shaped movable contact (3) with the bottom end placed on the first fixed contact and the bottom face facing the second fixed contact, an actuator (4) over the movable contact, and a metal shell (6) shielding over the insulating housing. The actuator is made of an elastomer and includes a tubular periphery part (41), an operation part (43), a thin-walled part (42) inclining downwardly from the bottom of the operation part and connecting the operation part with the periphery part, a pressing part (431) downwardly protruding from the operation part and resisting on the top surface of the movable contact, and a retaining part (44) extending from the top of the periphery part.

9 Claims, 4 Drawing Sheets

PUSH-ON SWITCH HAVING IMPROVED ACTUATOR

BACKGROUND OF THE INVENTION

1. Field of the Invention

The present invention relates generally to a push-on switch, and more particularly to a push-on switch having an actuator that is used as an operating switch for an input operation unit in an electric apparatus including an electric component.

2. Description of Related Arts

U.S. Pat. No. 7,109,431 issued to Yanai et al. on Sep. 19, 2006 discloses a conventional push-on switch including an insulative case provided with a base portion and a peripheral side wall projecting from the base portion generally in a first direction so as to form a recess opening in the first direction, a plurality of electrically independent fixed contacts disposed on a surface of the base portion of the case that faces in the first direction, a dome-shaped movable contact supported on the surface of the base portion and having a first portion non-movably contacting a first fixed contact, and a top central portion movably supported for movement toward a second fixed contact in a second direction opposite the first direction, an elastic body supported in the recess of the case, and a cover mounted to the case and covering the recess of the case. The fixed contacts include at least the first fixed contact and the second fixed contact.

The elastic body includes an engaging part having a pressing part facing in the second direction toward the top central portion of the dome-shaped movable contact. However, a gap along a vertical direction exists between the pressing part and the top central portion in an initial position where the dome-shaped movable contact is not downwardly pressed by the engaging part. Because of the gap, the height of the push-on switch is large, and accordingly, the movable distance of the pressing part for connecting the movable contact and the second fixed contact is long. As a result, the arrangement of the engaging part and the second fixed contact is not suitable to make a miniaturized push-on switch.

Hence, a new push-on switch with improved actuator is desired.

SUMMARY OF THE INVENTION

Accordingly, the present disclosure discloses a push-on switch according to the present disclosure includes an a push-on switch includes an insulating housing defining a recess at its top, a first fixed contact and a second fixed contact being electrically independent received at the bottom of the recess, a dome shaped movable contact with the bottom end of the dome shape thereof placed on the first fixed contact and the bottom face of the central top thereof facing the second fixed contact, an actuator over the movable contact and received in the recess, and a metal shell shielding over the insulating housing. The actuator is made of an elastomer and includes an tubular periphery part, an operation part, a thin-walled part inclining downwardly from the bottom of the outer circumference of operation part and connecting the operation part with the periphery part, a pressing part downwardly protruding from the operation part and resisting on the top surface of the central top of the movable contact, and a retaining part extending from the top of the outer circumference of the periphery part.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
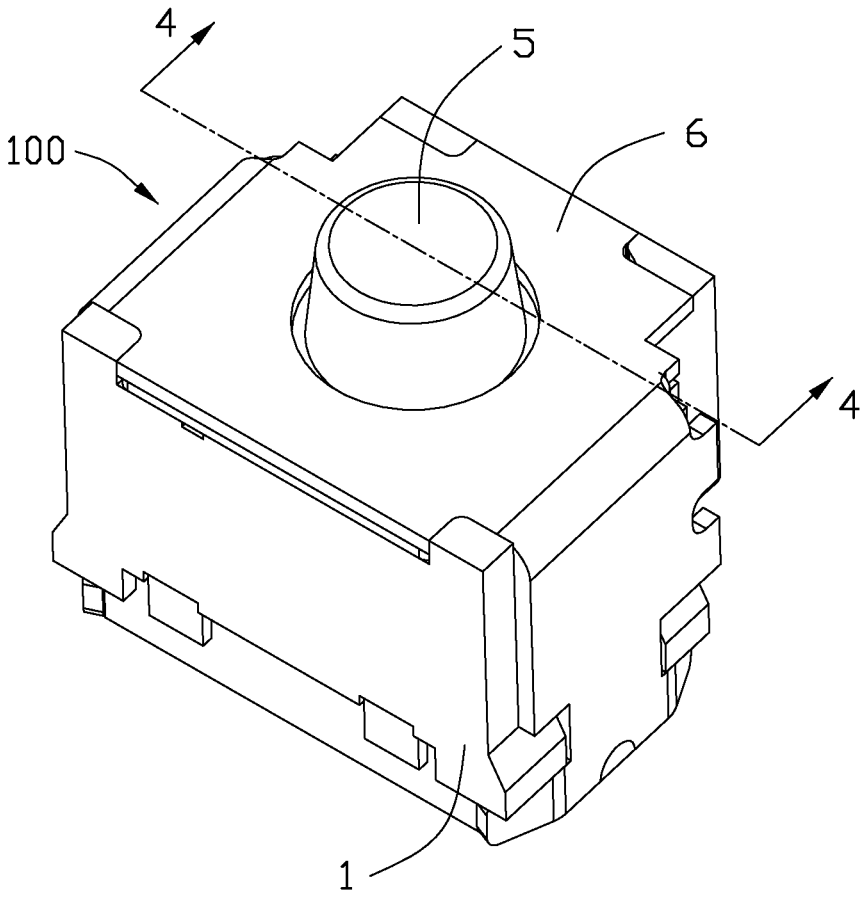
FIG. 1 is a perspective, assembled view of a push-on switch constructed in accordance with a preferred embodiment of the present disclosure.

Reference will now be made in detail to the preferred embodiment of the present disclosure.

Referring to FIGS. 1-4, a push-on switch 100 comprises an insulating housing 1, a pair of fixed contacts 2 received in the insulating housing 1, a movable contact 3 over the fixed contacts 2 and received in the insulating housing 1, an actuator 4 above the movable contact 3 and also received in the insulating housing 1, a knob 5 covering the actuator 4, and a metal shell 6 shielding over the insulating housing 1.

Figure 2:
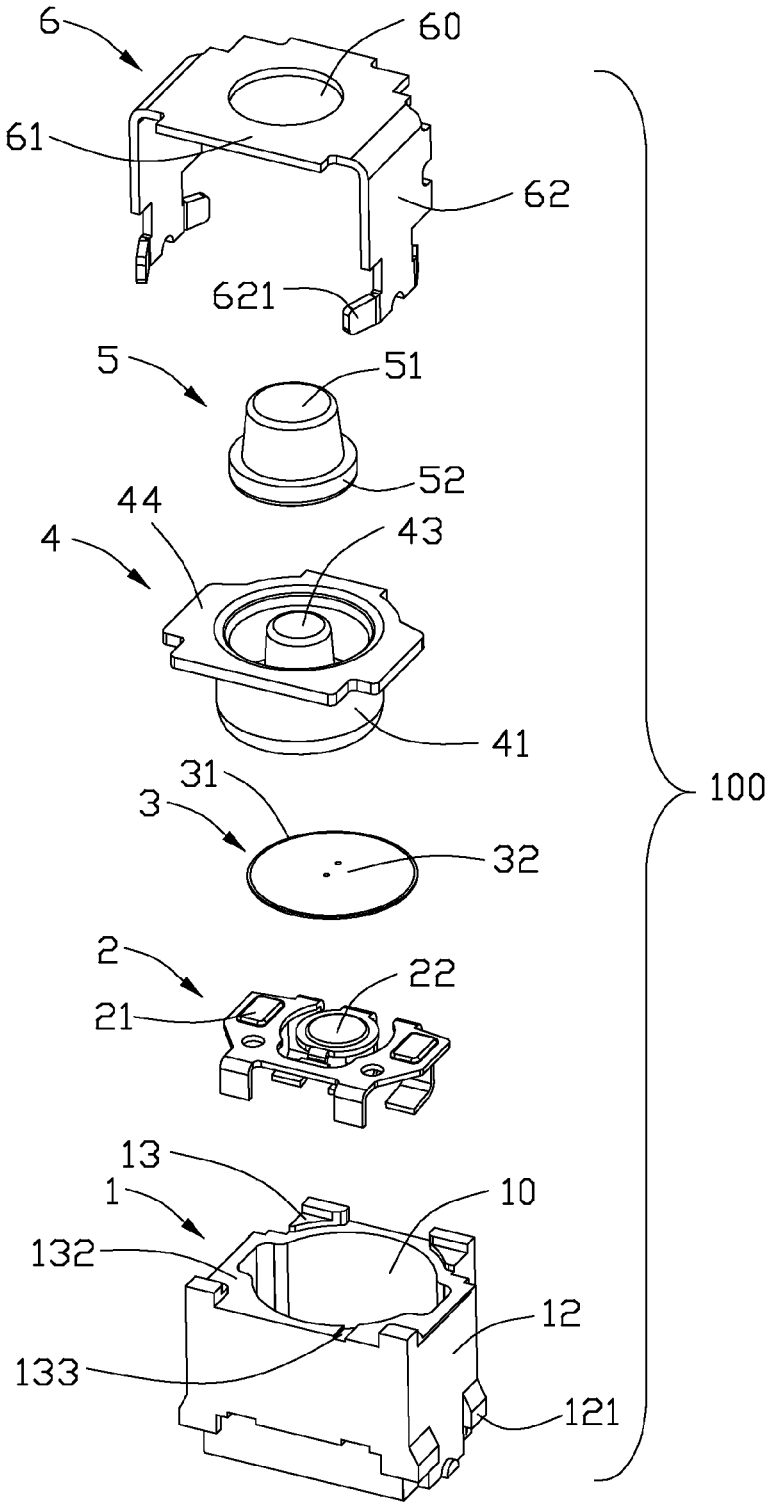
FIG. 2 is a perspective, exploded view of the push-on switch as shown in FIG. 1.
Figure 3:
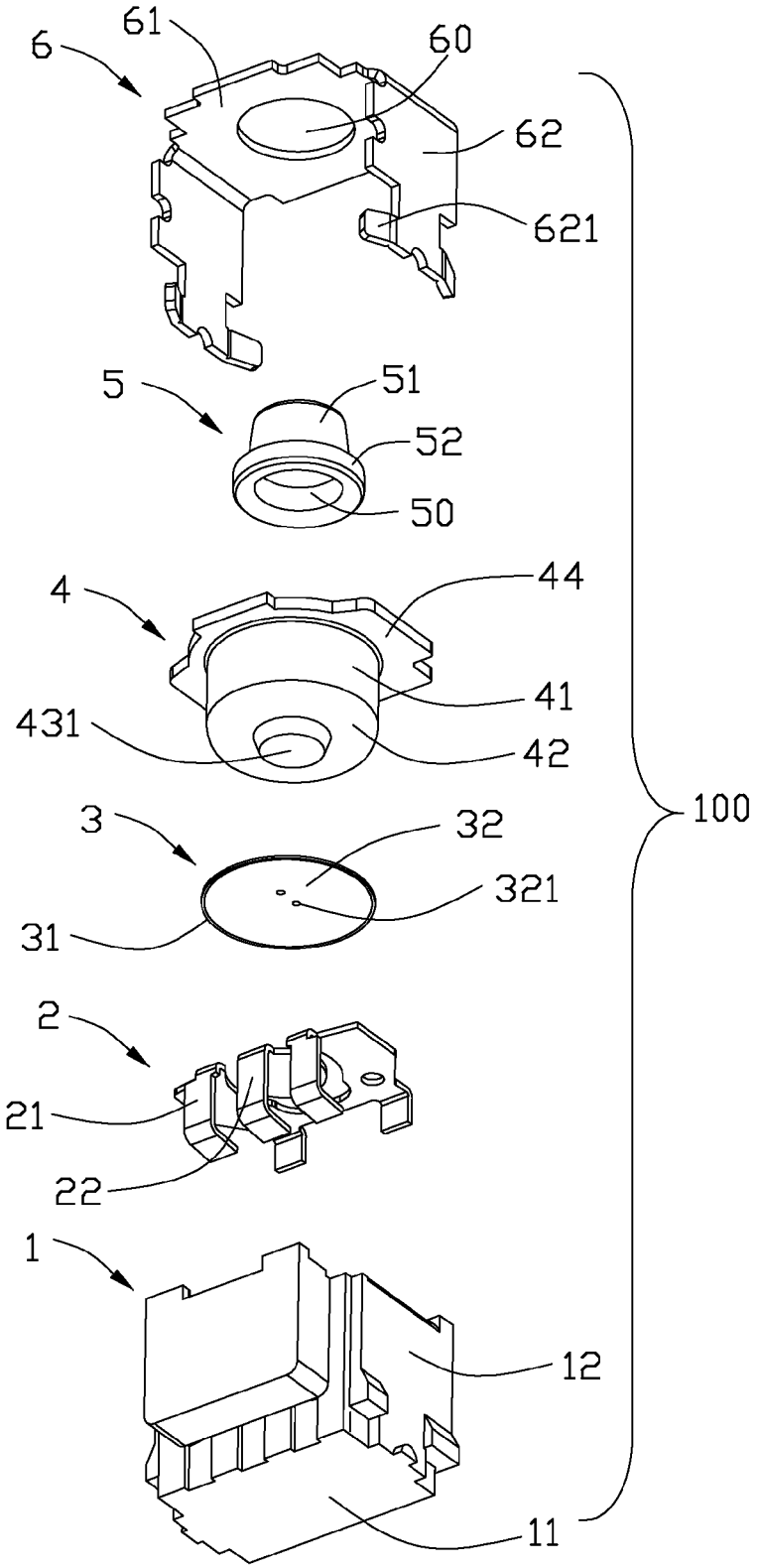
FIG. 3 is another exploded view of FIG. 2.

Referring to FIGS. 2 and 3, the insulating housing 1 includes a base 11 and two pairs of face-to-face sidewalls 12 extending upwardly from the periphery of the base 11. The sidewalls 12 connecting with each other and together with the base 11 forms a recess 10 of the insulating housing 1 at its top portion 13. The top portion 13 is the top of the sidewalls 12. The top portion 13 also defines a depressed part 132 downwardly therefrom, and the depressed part 132 of one sidewall 12 further defines a groove 133 covered by a retaining part 44 below-mentioned which communicates outside with the recess 10, that is the groove 133 allows internal and external air in the space above the movable contact 3 to circulate and so that the operation force will be hardly influenced due to the air compression.

The fixed contacts 2 include a first fixed contact 21 located at the bottom outer circumference of the recess 10 and a second fixed contact 22 located at the bottom central position of the recess 10. The first fixed contact 21 and the second fixed contact 22 are electrically independent from each other at the bottom of the recess 10.

The movable contact 3 received in the recess 10 of the insulating housing 1 is formed in an upwardly convex dome shape. The bottom end of the dome shaped outer circumference 31 is placed on the first fixed contact 21. The bottom surface of the central top 32 of the movable contact 3 faces the above-mentioned second fixed contact 22. The central top 32 of the movable contact further forms a dimple 321 downwardly in order to make the contact between the movable contact 3 and the second fixed contact 22 more steadily when the movable contact 3 is downwardly pressed.

The actuator 4 positioned above the movable contact 3 is made of an elastomer, and the actuator 4 includes a tubular periphery part 41 with a diameter roughly identical to that of movable contact 3 and an operation part 43 movably connected to periphery part 41 through a thin-walled part 42. The thin-walled part 42 is a conical part with its bottom open, and inclined downwardly from the bottom of the outer circumference of the operation part 43. The bottom end surface of the operation part 43 defines a small-diameter pressing part 431 downwardly protruding therefrom and lower than the bottom of the periphery part 41. The periphery part 41 further defines a retaining part 44 extending from the top of the outer circumference thereof. Here, the respective parts of the actuator 4 are integrally formed. And the pressing part 431 pre-presses the movable contact 3. After being assembled, the retaining part 44 covered by the metal shell 6 is received in the depressed part 132 of the insulating housing 1 to make sure the actuator 4 not sway in horizontal direction. The thickness of the retaining part 44 is a little larger than the depth of the depressed part 132 to make sure the actuator 4 not sway in the up and down direction when the metal shell 5 shields over and locks with the insulating housing 1. In the present disclosure, the structure of the actuator 4 is simple comparatively, and the pressing part 431 resists on the movable contact 3 in the initial state, so the distance of the actuator 4 moves up and down when pressed is short comparatively, consequently, the height of the actuator 4 could be lower, which conduce to miniaturization of the push-on switch.

The knob 5 defining a cap shape and capping the top end of the operation part 43, includes a base portion 51 with an open hole 50 at the bottom thereof, and a stop portion 52 protruding outwardly from the bottom of the outer circumference of the base portion 51. In the condition of making sure the steadily of operation, the knob 50 capping the top end of the operation part 43 used as operating part could reduce the diameter of the operation part 43 and further increase the length of the thin wall 42, so that the elasticity of the actuator 4 is increased.

The metal shell 6 mounting to the insulating housing 1 and covering the recess 10 of the insulating housing includes a flat portion 61 and a pair of sidewalls 62 extending downwardly from two edges of the flat portion 61. The flat portion 61 defines a hole 60 in the central part thereof, and the above-mentioned base portion 6 of the knob 5 projects upwardly through the hole 60, and the stop portion 52 of the knob 5 prevents the knob 5 from jumping out of the hole 60. Each sidewall 62 forms a pair of locking parts 621 at the bottom thereof to lock with corresponding locking portions 121 formed at the bottom of the side wall 12 of the insulating housing 1.

Figure 4:
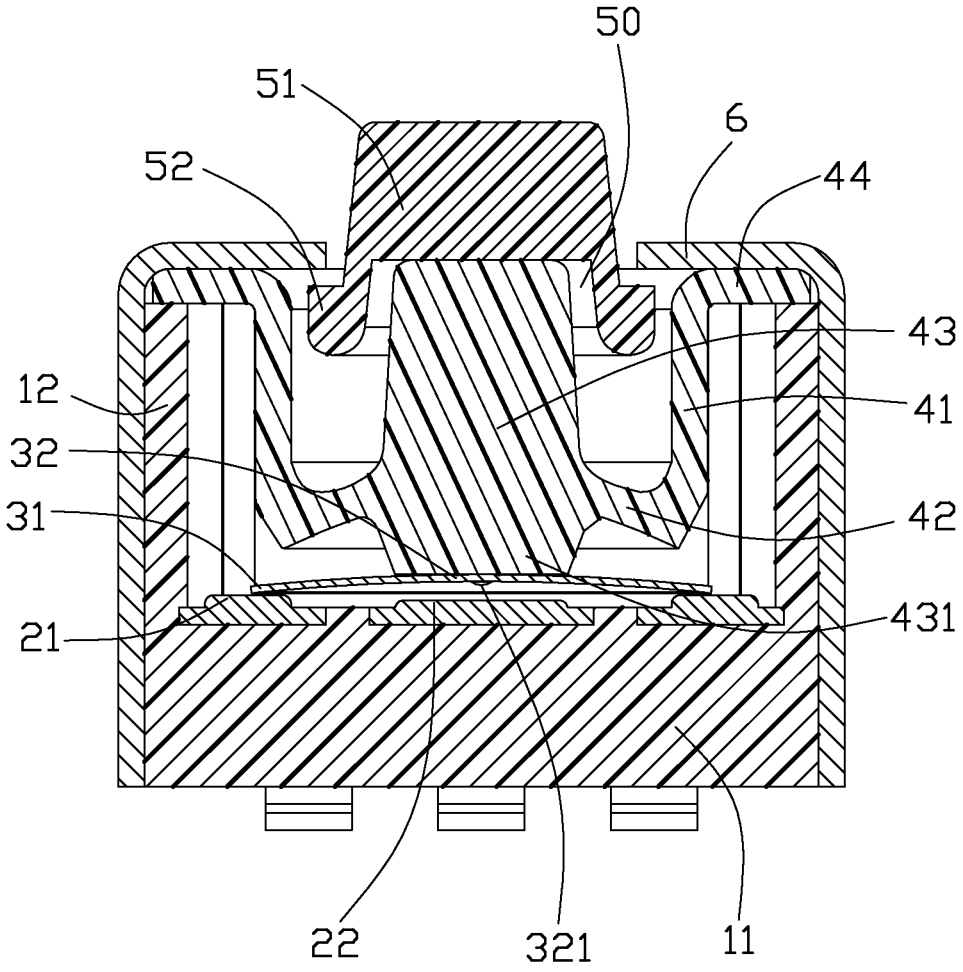
FIG. 4 is a cross-sectional view taken along line 4-4 of FIG. 1.

After assembling, in initial state, the bottom end of the dome shaped outer circumference 31 of the movable contact 3 connects with the first fixed contact 21 and the bottom surface of the central top 32 of the movable contact 3 faces the second fixed contact 22. This is an initial switch-off state as shown in FIG. 4. The pressing part 431 of the actuator 4 resists on the top surface of the central top 32 of the movable contact 3.

In use, the operator presses the knob 5, and the actuator 4 is pressed through the knob 5, the central top 32 of the movable contact 3 is immediately pressed by the pressing part 431 of the actuator 4, and a given force causes the movable contact 3 to invert at its central part 431 with a comfortable feeling to the operator. Consequently, the dimple 321 of the movable contact 3 touches the centrally-located second contact; and then externally-located first fixed contact portion 21 short-circuits with centrally-located second fixed contact 22 through movable contact 3, to enter a switch-on state.

When the pressing of the knob 5 is taken away, the given force on the movable contact 3 immediately disappears, and the movable contact 3 returns to the initial state, upwardly convex dome shape, with comfortableness, owing to its own restorative force, to separate from centrally-positioned second fixed contact 22. Then, the actuator 4 is pressed back upwardly according to the restorative action, to enter the initial switch-off state. And the pressing part 431 of the actuator 4 returns to resist on the top surface of the central top 32 of the movable contact 3.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A push-on switch comprising:

an insulative housing defining a cavity;

a plurality of stationary contacts disposed in the housing with soldering section exposed outside of the housing;

a moveable contact disposed in the housing and defining an upward bulged configuration with a periphery section constantly connected to one of the stationary contacts and a center section selectively connected to another one of the stationary contacts; and an actuator made of elastic material and defining a circumferential wall essentially extending in an up-and-down direction, a bottom wall linked to a lower region of the circumferential wall, extending radially and inwardly to a center of the actuator and deformable in the up-and-down direction, and an operation part essentially located in the center, linked to the bottom wall and extending in the up-and-down direction to be moveable between opposite upper and lower positions in the up-and-down direction to downwardly actuate the moveable contact; wherein a lower end of the operation part constantly contacts the moveable contact disregarding whether the operation part is located at either the upper position or the lower position; and wherein the bottom wall extends in an upward bulged manner and never is deformed in a downward bulged manner.

2. The push-on switch as claimed in claim 1, further including a retaining part linked to an upper region of the circumferential wall and supported by the housing to have the circumferential wall and the associated operation part in suspension manner.

3. The push-on switch as claimed in claim 2, wherein said retaining part extend outward and radially from the center of the actuator.

4. The push-on switch as claimed in claim 2, wherein said retaining part is directly seated upon the housing.

5. The push-on switch as claimed in claim 1, further including a stopper of an outward rim shape located around an upper portion of the operation part and extending toward the circumferential wall for anti-dust consideration.

6. The push-on switch as claimed in claim 5, wherein said stopper is unitarily formed on a knob which is constantly positioned upon an upper end of the operation part and exposed outside of the cavity for access from an exterior.

7. The push-on switch as claimed in claim 1, wherein a bottom rim region of the circumferential wall defines a chamfer structure along an exterior face thereof corresponding to the bottom wall for forgiving deformation of the bottom wall.

8. A push-on switch comprising:

an insulative housing defining a cavity;

a plurality of stationary contacts disposed in the housing with soldering section exposed outside of the housing;

a moveable contact disposed in the housing and defining an upward bulged configuration with a periphery section constantly connected to one of the stationary contacts and a center section selectively connected to another one of the stationary contacts;

an actuator made of elastic material and defining a circumferential wall essentially extending in an up-and-down direction, a bottom wall linked to a lower region of the circumferential wall, extending radially and inwardly to a center of the actuator and deformable in the up-and-down direction, and an operation part essentially located in the center, linked to the bottom wall and extending in the up-and-down direction to be moveable between opposite upper and lower positions in the up-and-down direction to downwardly actuate the moveable contact; and a stopper of an outward rim shape located around an upper portion of the operation part and extending outwardly radially toward the circumferential wall for anti-dust consideration.

9. The push-on switch as claimed in claim 8, wherein said stopper is unitarily formed on a knob which is constantly positioned upon an upper end of the operation part and exposed outside of the cavity for access from an exterior.

* * * * *